US006679781B1

(12) United States Patent
Green

(10) Patent No.: US 6,679,781 B1
(45) Date of Patent: Jan. 20, 2004

(54) GOLF CLUB HEAD

(75) Inventor: Timothy M. Green, Fenton, MO (US)

(73) Assignee: Green-Maurer Golf LLC, Saint Louis, MO (US)

( * ) Notice: Subject to any disclaimer, the term of this patent is extended or adjusted under 35 U.S.C. 154(b) by 0 days.

(21) Appl. No.: 09/958,400

(22) PCT Filed: Apr. 25, 2000

(86) PCT No.: PCT/US00/11154

§ 371 (c)(1),
(2), (4) Date: Oct. 9, 2001

(87) PCT Pub. No.: WO00/64543

PCT Pub. Date: Nov. 2, 2000

Related U.S. Application Data

(60) Provisional application No. 60/130,965, filed on Apr. 26, 1999.

(51) Int. Cl.[7] ..... A63B 69/36

(52) U.S. Cl. ..... 473/226; 473/240; 473/242; 473/251; 473/256; 473/332; 473/342; 473/288

(58) Field of Search ..... 473/332, 333, 473/334, 335, 336, 337, 338, 339, 288, 226, 219, 238, 240, 242, 244, 251, 268, 254, 256, 340, 342, 327, 228

(56) References Cited

U.S. PATENT DOCUMENTS

| | | | | | |
|---|---|---|---|---|---|
| 1,975,341 | A | | 10/1934 | Young | 473/340 |
| 2,620,186 | A | * | 12/1952 | Beeaff | |
| 2,929,631 | A | * | 3/1960 | Gillon | |
| 3,468,545 | A | * | 9/1969 | Anderson | |
| 3,829,102 | A | * | 8/1974 | Harrison | |
| 3,921,984 | A | | 11/1975 | Winter | 473/251 |
| 4,077,633 | A | * | 3/1978 | Studen | |
| 4,121,832 | A | * | 10/1978 | Ebbing | |
| 4,422,638 | A | * | 12/1983 | Tucker | |
| 4,844,468 | A | | 7/1989 | Lee | 273/163 R |
| 4,919,424 | A | * | 4/1990 | Fukumochi | |
| 5,052,690 | A | | 10/1991 | Sharp | 273/183 D |
| 5,195,749 | A | * | 3/1993 | Ugarte | |
| 5,228,695 | A | * | 7/1993 | Meyer | |
| 5,351,962 | A | | 10/1994 | Lin | 273/286.2 |
| 5,417,429 | A | | 5/1995 | Strand | 273/187.4 |
| 5,433,444 | A | * | 7/1995 | Chiuminatta | |
| 5,433,446 | A | * | 7/1995 | Lindstedt | |
| 5,620,379 | A | | 4/1997 | Borys | 473/313 |
| 5,640,777 | A | | 6/1997 | Densberger et al. | 33/263 |
| 5,709,612 | A | | 1/1998 | Salado | 473/240 |
| 5,776,016 | A | | 7/1998 | Benoit et al. | 473/409 |
| 5,800,279 | A | * | 9/1998 | Densberger | |
| 5,896,230 | A | | 4/1999 | Goggins | 359/619 |

* cited by examiner

*Primary Examiner*—Sebastiano Passaniti
(74) *Attorney, Agent, or Firm*—Harness, Dickey & Pierce, PLC

(57) ABSTRACT

A golf club (110) has a head (111) with a curved reflective surface (128) for visually aligning a shot. The club head is counterbalanced above the plane of the ball (120) and has balance weights (116, 118) which may be selected to accommodate the style and preference of the user. The striking surface may be of a different material than the surrounding club head to dampen vibration on the stroke and may be of a material tailored to the user's preference. The other parts of the club may also be composites of several materials to assist in dampening vibration. An alternative aligning structure uses lenticular lens (142, 144, 146) to provide guiding images to the user.

8 Claims, 3 Drawing Sheets

GOLF CLUB HEAD

This application claims priority from U.S. provisional application serial No. 60/130,965, filed Apr. 26, 1999.

BACKGROUND OF THE INVENTION

1. Field of the Invention

The invention relates to the field of sports equipment and in particular to golf clubs. The invention is especially related to clubs for use in putting and to improvements in such clubs, but may be used on other clubs as well.

2. Brief Description of the Prior Art

Golf enthusiasts and equipment manufacturers have continually sought to improve golf clubs, including putters, for many years. These efforts have included the addition of structures to improve the play of the clubs and structures designed as teaching aids to assist in instruction in the use of particular clubs. For example, elements have been developed to assist in teaching effective putting technique. Club improvements, of both types, include elements designating the center of mass of the club head or the effective contact area of the club head, i.e., the "sweet spot." Modifications have also been added to assist the user in properly aligning the club head with the ball and the desired path of the ball to achieve a true hit and an accurate shot.

The following U.S. Patents are incorporated by reference herein:

U.S. Pat. No. 1,975,341
U.S. Pat. No. 3,921,984
U.S. Pat. No. 4,844,468
U.S. Pat. No. 5,052,690
U.S. Pat. No. 5,351,962
U.S. Pat. No. 5,417,429
U.S. Pat. No. 5,620,379
U.S. Pat. No. 5,640,777
U.S. Pat. No. 5,709,612
U.S. Pat. No. 5,776,016
U.S. Pat. No. 5,896,230

BRIEF SUMMARY OF THE INVENTION

The present invention relates to a golf club head having several novel features in a variety of combinations. The club head can include aligning means, such as reflective lenses or a reflective surface, as described herein. The club may also have a counterbalance above the plane of the ball and an arrow shape, as more particularly described below.

The club may also be constructed of a plurality of materials, as described herein. The various materials of construction preferably are of differing densities and thus have different vibrational modes. The different vibrational modes and densities act to cancel out the vibration produced on striking the ball and assist in providing a true hit of the ball.

The club head, such as a putter head, will preferably have the mass of the club distributed in the horizontal plane, rather than being concentrated at the center of mass. This distribution increases the moment of inertia of the club in the horizontal plane and increases the effective size of the "sweet spot" on the club face. The club is thus more effective at delivering a true hit, even if contact with the ball is off of the location of the center of mass of the club head.

It is an object of this invention to provide a golf club head, such as a putter head, which incorporates a vibration dampening structure.

It is an object of this invention to provide a golf club head, such as a putter head, which includes an optical aligning feature.

It is a further object of this invention to provide a golf putter head which has a curved reflective surface to aid in aligning a putt.

It is a further object of this invention to provide a golf putter which may accommodate a selectively installed striking surface.

It is a further object of this invention to provide a golf putter which has an improved sweet spot to create a true hit on contact with the ball.

An object of the present invention is to provide a golf club head with one or any combination of said features.

The invention summarized above comprises the constructions hereinafter described, the scope of the invention being indicated by the subjoined claims.

BRIEF DESCRIPTION OF THE SEVERAL VIEWS OF THE DRAWINGS

In the drawings, corresponding reference characters refer to corresponding parts throughout the several views of the drawings in which.

DETAILED DESCRIPTION OF THE INVENTION

Figure 1:
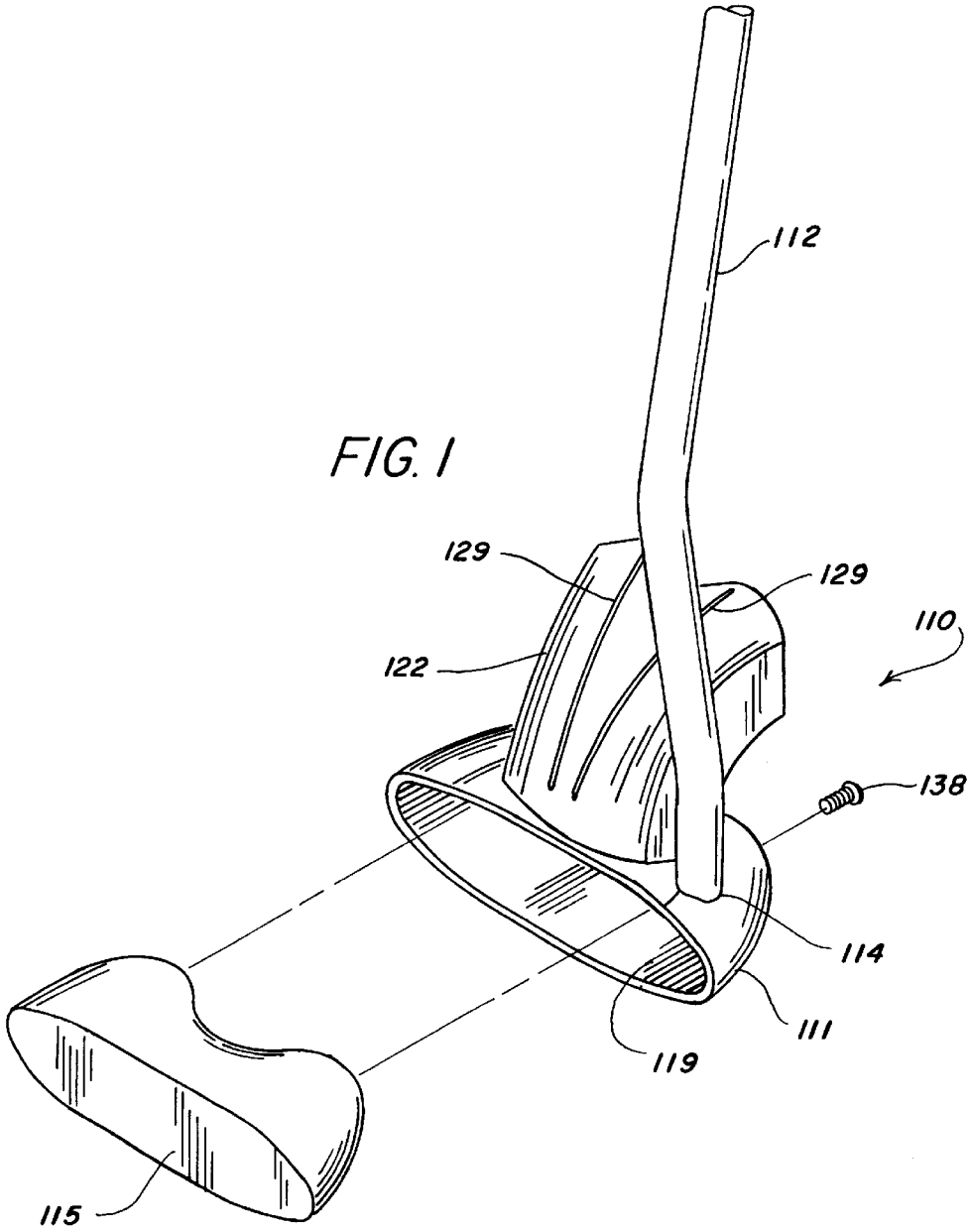
FIG. 1 is a front, exploded, perspective view of a golf putter head in accordance with the present invention.
Figure 3:
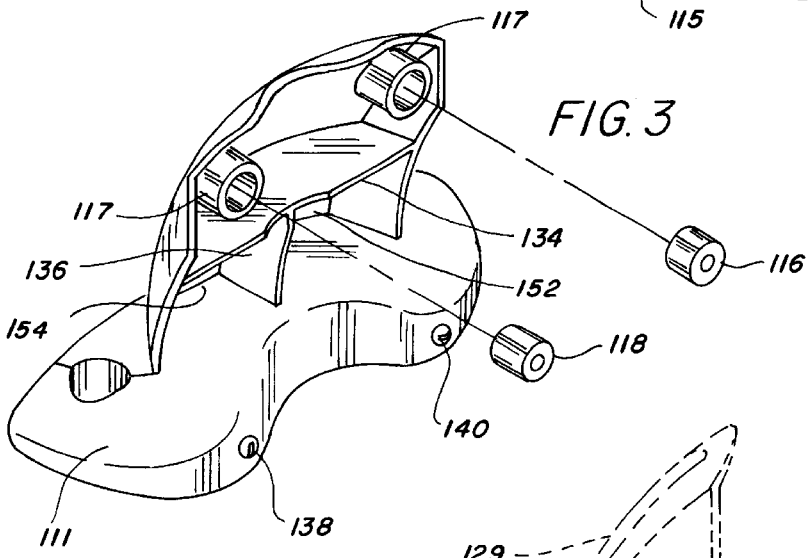
FIG. 3 is a rear perspective view of the golf putter head shown in FIG. 1.
Figure 4:
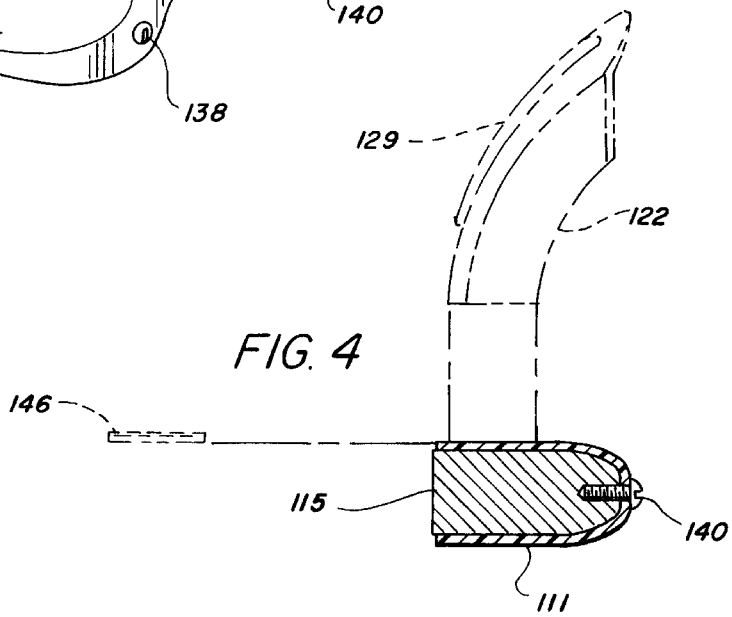
FIG. 4 is an exploded cross-sectional view of the golf putter head shown in FIG. 1, with alternative aligning means shown in phantom.

Referring particularly to FIGS. 1 and 3, a golf putter head or club head 110 in accordance with the present invention has a club head body 111 which is preferably constructed from a low density material, for example a plastic such as a high density polypropylene or similar material. The club head 110 may be fastened to a shaft 112 mounted in shaft hole 114, as known in the art. The club head may be provided with specific inserts 115, 116, and 118 of higher density material, such as lead, aluminum, brass or stainless steel. The particular materials may be chosen to suit the preference of the individual golfer. A harder material for insert 115 will impart a sharper impact to the ball, on contact. A softer material will impart a softer impact to the ball, on contact. It will be understood, however, that club head 110 and club head body 111 may be produced out of a higher density material, such as stainless steel, aluminum or brass. The club head 110 may also us a lower density insert 115 in the front cavity 119, for example, a plastic material such as high density polypropylene or equivalent.

Higher density inserts 115, 116, and 118 are located to provide and enhance specific club head functions. For example, insert 115 in the front face of the club head 110 functions as the primary striking surface. Insert 115 provides a small concentrated area of weight and mass in the vertical plane. The vertical dimension of insert 115 preferably is smaller than the diameter of a golf ball 120. This focuses more of the force of impact into the ball and results in a more straight and true putt with less of a club stroke. The horizontal dimension of insert 115 is extended to increase the moment of inertia of the club head 110 in the horizontal plane; this extends the "sweet spot" of the club head and assists in providing a true hit when the ball is struck off center. Insert 115 also preferably is formed of material having a specific "coefficient of restitution." This material may be tailored to the preference of the user. A particular user may be comfortable with a very hard insert 115, which provides a sharp impact on contact with the ball. Another user may be comfortable with a soft insert 115, which provides a soft impact on contact with the ball. The features preferred by the user can assist in providing consistent straight and true putts.

Front insert 115 is sized and located to work with other inserts 116 and 118 in producing a specifically located center of gravity that ensures a more straight and true putt. Specific inserts 116 and 118 are also located from the rear of club head 110 in sockets 117. For example, these inserts are located to work with front insert 115 and produce a specific center of gravity.

Inserts 116 and 118 are located at the top of a vertically rising structure 122 starting directly above the small contact area of the club face, and gradually expanding in width as it rises and curves back along a geometric path. Inserts 116 and 118 are located at the top of the vertically rising structure 122. Inserts 116 and 118 provide a counterbalancing effect for the club. Since they are located wider and higher than golf ball 120, the force of impact between club head 110 and golf ball 120 is better distributed. This permits the club head 110 to swing through more smoothly and increases the opportunity for a straight and true putt. Vertically rising structure 122 is preferably made of a lower density material, and thus is flexible. With inserts 116 and 118 at its top, the vertically rising structure flexes like a spring, absorbing the golf ball impact. The system behaves like a "spring/damper," increasing the chance of an uninterrupted smooth swing and increasing the opportunity for a straight and true putt.

Figure 6:
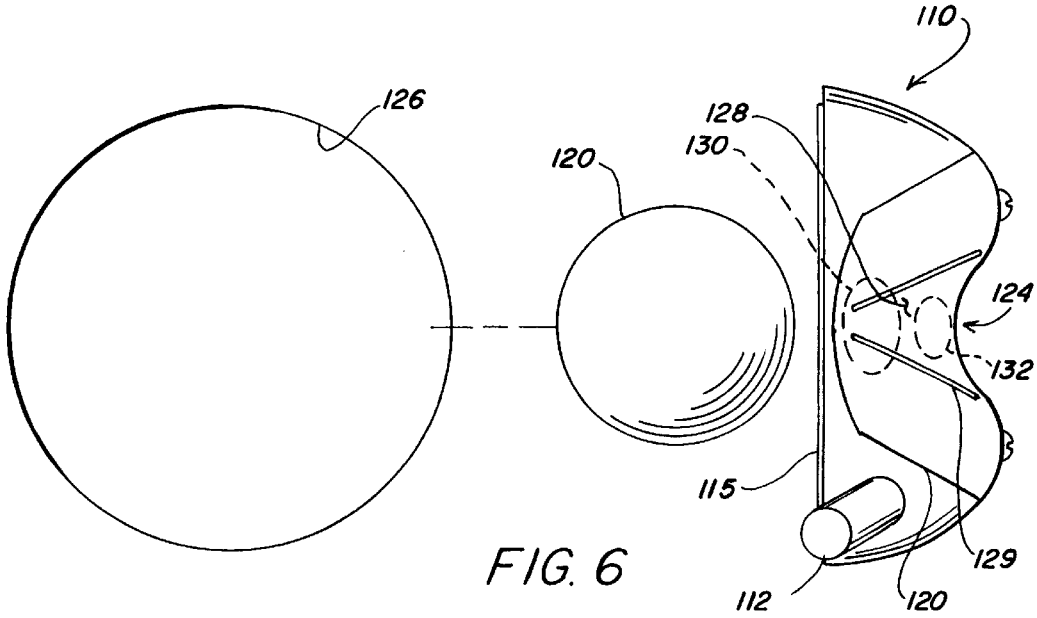

Vertically rising structure 122 gradually expands in width as it rises and curves back along a geometric path. When vertically rising structure 122 is viewed from above as seen in FIG. 6, it takes the shape of an arrowhead 124. This results in a dramatically improved way of aligning club head 110 along a prescribed path towards a hole or pin 126; the construction of club head 110, using vertically rising structure 122 is especially useful as a training device and as a practice tool to develop a good putting stroke. More particularly, vertically rising structure 122 allows the golfer to match the rear curve of arrowhead 124 with the rear curve of body 111 for perfect alignment of club head 110 with ball 120.

Figure 5:
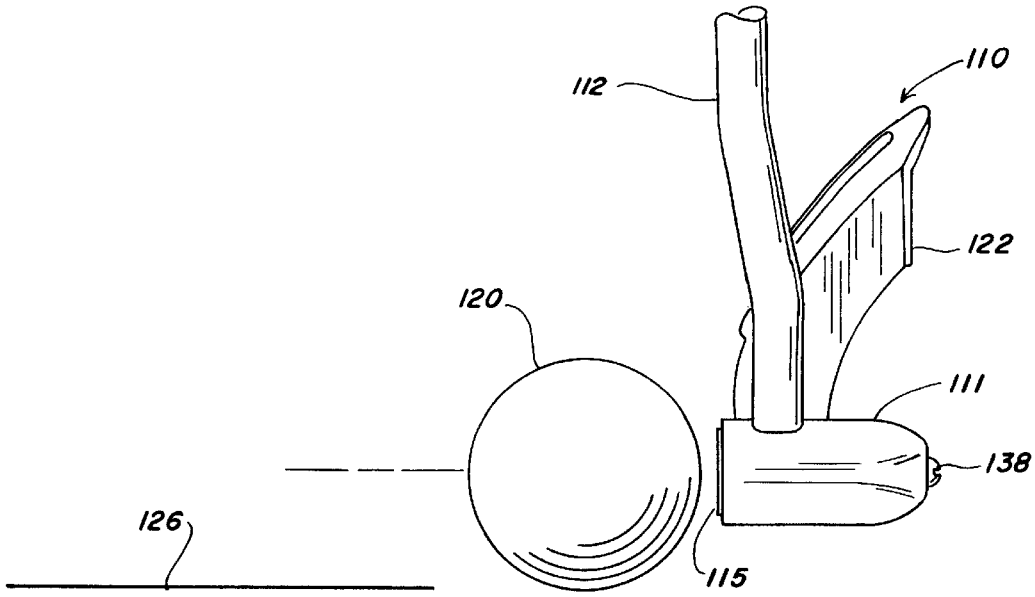
FIG. 5 is a side elevational view of the golf putter head shown addressing a golf ball; and, FIG. 6 is a top plan view of the golf putter head reflecting the golf ball and a golf hole or pin.

A front surface 128 of vertically rising structure 122 has a tapered center reflective surface, for example formed of sputter coated aluminum, that allows the golfer to visually align golf ball 120, with a reflection 130 of the golf ball and a reflection 132 of hole or pin 126 as shown in FIG. 5. Front surface 128 of vertically rising structure 122 can be flat or preferably slightly curved in its third dimension, as shown. As club head 110 is stroked, reflections 130, 132 should stay along the visual centerline of tapered mirror surface 128, and within the diverging curved boundary lines 129, shown in FIG. 1; if they do not, then the golfer is not stroking along the correct path towards the hole. Correction is made by changing the stance and club alignment to correctly position the image of reflections 130, 132 on mirror surface 128.

When club head 110 is made out of a low density material, such as injection moldable plastic, it has the enhanced ability to have "snap fit" details molded into its shape. For example, there can be "snap" details on the rear of vertically protruding vertically rising structure 122 that can hold certain golf accessories. These can include golf tees, golf divot repair tools and golf ball markers, not shown. If club head 110 is produced out of a higher density material, using a lower density insert 115 in the front cavity, the club head still has the advantages of the vertically rising structure 122 and inserts 116 and 118 above the plane of the ball. As shown in FIG. 3, vertically rising structure 122 may be provided with strengthening webs 134 and 136 to increase the strength of this element without increasing its weight. Strengthening webs 134 and 136 form cavities 152 and 154 on the back side of vertically rising structure 122, as shown. Cavities 152 and 154 can receive "snap fit" structures for golf accessories, as previously described. Cavities 152 and 154 can also receive additional inserts, not shown, to adjust the weight and balance of the club head 110 to suit the style and preference of the club user. Also as shown in FIG. 3, insert 115 may be held in cavity 119 by fasteners 138 and 140. Fasteners 138 and 140 may be conventional elements, such as machine screws, as shown.

It will be appreciated that the various elements described herein, such as inserts 115, 116, 118, and the structure receiving these elements may be formed to be interchangeable by the use of "snap fit" mating elements, such detent and socket features, not shown, and by the use of removable fasteners such as machine screws 138 and 140. Thermoplastic adhesives and equivalent materials may also be used to provide further reliability to the constructed club head 110 and still permit the elements of club head 110 to be interchanged to suit the preferences of the user. For example, insert 115 may be replaced by the user to compensate for wear or breakage or to interchange hard or soft striking surfaces, i.e., brass, lead or plastic. The construction of club head 110 may also be made substantially permanent, if desired. For example, a substantially permanent adhesive, such as a catalytic epoxy or equivalent, may be used to join the elements of club head 110.

Figure 2:
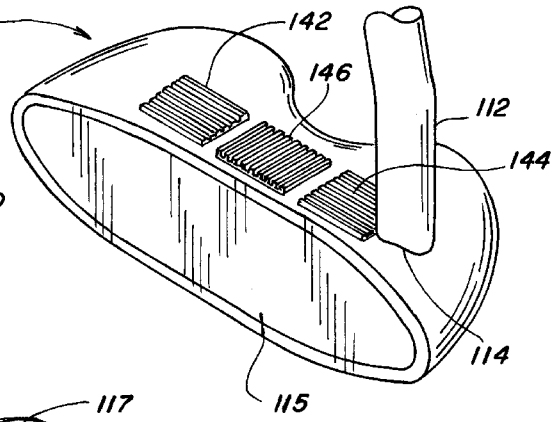
FIG. 2 is a front perspective view of a modified assembled golf putter head, similar to that shown in FIG. 1, but with a different aligning means.

Referring to FIG. 2, an alternative embodiment is shown which has a further alternative aligning guide means. In this construction, alignment is provided by reference to a set of reflective elements or lens, 142, 144 and 146 which are mounted on the upper surface of club head 110, as shown, for example by an adhesive, as known in the art. Preferably elements 142, 144 and 146 are lenticular lens, for example, of the type commonly used to decorate credit cards with multiple images. Suitable structures are also described in U.S. Pat. No. 5,896,230. The lens 142, 144 and 146 are aimed to provide an image to the user when the head of the user is positioned directly over the club head 110, the proper position for putting. When the user looks down at the club head 110 the three images from lenses 142, 144 and 146 are in view. As the club is stroked, all three images remain in view if the club is stroked along the proper path through the ball.

The image viewed by the golfer, when in position, can be color or other indicia such as parallel arrows indicating the direction of the club stroke. If the golfer's head is improperly positioned other images are seen by the golfer, indicating an error in the address of the ball and suggesting correction. For example, a different color is seen or a different set of arrows is seen suggesting repositioning of the stance forward or backward. It will be appreciated that combinations of indicia may also be used, such as color and shapes.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A golf club putter having a club head including a club head body and a striking surface, the club head body having an insert located therein and the striking surface being located on the insert, the insert being of a different material than the club head body and being fastened to the club head body, the insert and the club head body being substantially elongated in the transverse horizontal direction and the insert being of reduced length in the vertical direction and the longitudinal horizontal direction, parallel to a club stroke, to increase the rotational inertia of the club in the horizontal plane, the club head further having a vertically rising structure extending upwardly from a top surface of the club head and gradually expanding in width as it rises, said vertically rising structure comprising a flexible material for permitting the vertically rising structure to act as a spring/damper when the club head strikes a golf ball.

2. The golf club putter of claim 1 having inserts of higher density material than the vertically rising structure, said inserts being positioned on the vertically rising structure to increase the rotational inertia of the club in the horizontal plane.

3. The golf club putter of claim 1 wherein the vertically rising structure curves back with curvature in both the vertical and horizontal planes.

4. The golf club putter of claim 3 wherein the vertically rising structure has a light reflective surface to reflect an image of a golf ball to the user.

5. The golf club putter of claim 4 wherein the reflective surface includes a plurality of reference elements, the reference elements diverging in an upward and rearward direction from the golf club head, the portion of the reflective surface between the diverging reference elements providing means for visually indicating the location of a golf ball, the proper stance of a user and alignment of a stroke of the club.

6. The golf club putter of claim 3 wherein a rear curve of the vertically rising structure is matched with a rear curve of the club head body for perfect alignment with a golf ball.

7. A golf club putter having a club head including a club head body and a striking surface, the club head body having an insert located therein and the striking surface being located on the insert, the insert being of a different material than the club head body and being fastened to the club head body, the insert and the club head body being substantially elongated in the transverse horizontal direction and the insert being of reduced length in the vertical direction and the longitudinal horizontal direction, parallel to a club stroke, to increase the rotational inertia of the club in the horizontal plane, the club head further having a set of lenticular lenses on a top surface of the club head with a central lens flanked by right and left lenses, said right and left lenses being at an angle to the central lens whereby all three lenses remain in view if the club head is stroked along a proper path through the ball.

8. The golf club putter of claim 7 wherein the right and left lenses are at a right angle to the central lens.

* * * * *